US008651019B1

(12) United States Patent
Guo et al.

(10) Patent No.: US 8,651,019 B1
(45) Date of Patent: Feb. 18, 2014

(54) CRANK PRESS WITH DUAL PROTECTION MECHANISM AND CONTROL METHOD THEREOF

(75) Inventors: Ya-Huei Guo, Taoyuan County (TW); Tin-Chun Kuo, Taoyuan County (TW); Jin-Hung Hsu, Taoyuan County (TW); Ming-Yang Lin, Taoyuan County (TW); Kuei-Chang Hsu, Taoyuan County (TW); Yi-Wen Wang, Taoyuan County (TW); Ju-Ru Tsai, Taoyuan County (TW); Wei-Lun Hsu, Taoyuan County (TW)

(73) Assignee: Shieh Yih Machinery Industry Co., Ltd, Taoyuan County (TW)

( * ) Notice: Subject to any disclaimer, the term of this patent is extended or adjusted under 35 U.S.C. 154(b) by 0 days.

(21) Appl. No.: 13/600,529

(22) Filed: Aug. 31, 2012

(51) Int. Cl.
*B30B 13/00* (2006.01)
*B30B 15/14* (2006.01)
*B30B 15/26* (2006.01)

(52) U.S. Cl.
USPC ..... 100/35; 100/43; 100/50

(58) Field of Classification Search
USPC ..... 100/35, 43, 48, 50, 99; 72/17.2, 20.1, 72/21.3
See application file for complete search history.

(56) References Cited

U.S. PATENT DOCUMENTS 6,647,870 B2 * 11/2003 Kohno ..... 100/269.14
7,905,126 B2 * 3/2011 Suzuki ..... 72/20.1
2010/0170405 A1 * 7/2010 Onishi et al. ..... 100/35
2011/0132208 A1 * 6/2011 Asakawa et al. ..... 100/35
2011/1322208 6/2011 Asakawa et al.
2012/0111207 A1 5/2012 Kuboe

FOREIGN PATENT DOCUMENTS

| | | |
|---|---|---|
| GB | 2 177 832 | 1/1987 |
| JP | 55 078000 | 6/1980 |
| JP | 57 59190 | 4/1982 |
| JP | 62-9800 | 1/1987 |
| JP | 2004-174562 | 6/2004 |
| JP | 2004-174591 | 6/2004 |
| TW | 546911 | 8/2003 |
| TW | 557245 | 10/2003 |
| TW | I324094 | 5/2010 |

OTHER PUBLICATIONS

Extended European Search Report for EP Application No. 12182766.1, dated Jan. 17, 2013.
Taiwanese Search Report for Taiwan Application No. 100107378, dated May 15, 2013 and English translation.

* cited by examiner

*Primary Examiner* — Jimmy T Nguyen
(74) *Attorney, Agent, or Firm* — Hunton & Williams LLP

(57) ABSTRACT

A crank press includes an encoder measuring an angle value of a servo motor, a strain detector module generating a converted load value associated with deformation of a machine body, a memory storing at least one relation between an angle value and each of an upper torsion limit and an upper load limit, and a controller calculating a torque command value based on a position command, reading the upper torsion limit corresponding to the measured angle value, determining whether the torque command value exceeds the upper torsion limit, outputting the torque command value when negative, and outputting the upper torsion limit when affirmative. The controller further stops the servo motor when the converted load value exceeds the upper load limit corresponding to the measured angle value.

3 Claims, 3 Drawing Sheets

CRANK PRESS WITH DUAL PROTECTION MECHANISM AND CONTROL METHOD THEREOF

BACKGROUND OF THE INVENTION

1. Field of the Invention

The present invention relates to a crank press and a control method thereof, more particularly to a crank press with a dual protection mechanism and a control method thereof.

2. Description of the Related Art

Referring to FIG. 1, a conventional punch device 900, which is provided with a hydraulic overload protector, of a press machine is illustrated. The punch device 900 includes a slider 90, a hydraulic tank 91 disposed in the slider 90, a cover block 92 disposed at a lateral wall of the slider 90, a hydraulic pump 93 disposed on the cover block 92, and an overload controller 94. The slider 90 is formed with an opening 901 which communicates fluidly with the hydraulic tank 91. The cover block 92 is disposed to cover the opening 901, and a hydraulic outlet 921 is formed through the cover block 92 and communicates fluidly with the opening 901. The hydraulic pump 93 pumps hydraulic oil out of the hydraulic tank 91 and sends the hydraulic oil into a hydraulic cylinder 95 which is located above the hydraulic tank 91 via the hydraulic outlet 921. The overload controller 94 detects pressure in the hydraulic cylinder 95.

When the punch device 900 punches a workpiece (not shown) and receives a reaction force therefrom, the hydraulic oil in the hydraulic cylinder 95 is compressed so that pressure of the hydraulic oil is changed. At this moment, when the overload controller 94 detects that the pressure in the hydraulic cylinder 95 exceeds a predetermined pressure, the overload controller 94 controls the hydraulic pump 93 to stop pumping and sending the hydraulic oil to the hydraulic cylinder 95, or to release the hydraulic oil from the hydraulic cylinder 95 so as to prevent an excessive pressure in the punch device 900. On the other hand, a control system of the press machine may drive a clutch to disengage a power connection between the punch device 900 and a servo motor of the press machine, or may activate a brake for achieving an effect of overload protection.

However, the control mechanism of the conventional hydraulic overload protector has the following drawbacks.

1. Oil pressure change is unstable such that the control mechanism may not be implemented with ease.

2. The punch device 900 is protected passively only when overload happens, and may not be protected actively.

SUMMARY OF THE INVENTION

Therefore, an object of the present invention is to provide a crank press which may be controlled precisely and which is provided with a dual protection mechanism, and a control method thereof.

According to a first aspect of the present invention, a crank press comprises a machine body, a slider, a motor driver, a servo motor which is coupled to the slider and which is coupled to and driven by the motor driver to bring about movement of the slider with respect to the machine body, a command generator for generating a position command which is associated with control of the motor driver, an encoder, a strain detector module, a memory, and a controller.

The encoder measures an angle value associated with operation of the servo motor. The strain detector module includes a strain detector unit and a strain control unit. The strain detector module detects deformation of the machine body during movement of the slider within a pressing operation and generates a strain value corresponding to the deformation detected thereby. The strain control unit receives the strain value from the strain detector unit and converts the strain value into a converted load value. The memory stores at least one relation between an angle value and each of an upper torsion limit and an upper load limit corresponding thereto.

The controller includes a torsion control unit and a load control unit. The torsion control unit receives the position command from the command generator and the angle value measured by the encoder, calculates a torque command value based on the position command, reads from the memory the upper torsion limit corresponding to the angle value received thereby, determines whether the torque command value exceeds the upper torsion limit, outputs the torque command value to the motor driver for driving the servo motor according to the torque command value when the torque command value does not exceed the upper torsion limit, and outputs the upper torsion limit to the motor driver for driving the servo motor according to the upper torsion limit when the torque command value exceeds the upper torsion limit.

The load control unit receives the converted load value from the strain control unit and the angle value measured by the encoder, reads from the memory the upper load limit corresponding to the angle value received thereby, determines whether the converted load value exceeds the upper load limit, and controls the motor driver to stop driving the servo motor when the converted load value exceeds the upper load limit.

According to a second aspect of the present invention, there is provided a control method for a crank press that includes a machine body, a slider, a motor driver, a servo motor which is coupled to the slider and which is coupled to and driven by the motor driver to bring about movement of the slider with respect to the machine body, and a command generator for generating a position command which is associated with control of the motor driver. The control method comprises the steps of:

a) storing in a memory at least one relation between an angle value and each of an upper torsion limit and an upper load limit corresponding thereto;

b) measuring an angle value associated with operation of the servo motor;

c) generating a strain value corresponding to deformation of the machine body during movement of the slider within a pressing operation, and converting the strain value into a converted load value;

d) calculating a torque command value based on the position command, reading from the memory the upper torsion limit corresponding to the angle value measured in step b), determining whether the torque command value exceeds the upper torsion limit, outputting the torque command value to the motor driver for driving the servo motor according to the torque command value when the torque command value does not exceed the upper torsion limit, and outputting the upper torsion limit to the motor driver for driving the servo motor according to the upper torsion limit when the torque command value exceeds the upper torsion limit; and e) reading from the memory the upper load limit corresponding to the angle value measured in step b), determining whether the converted load value exceeds the upper load limit, and controlling the motor driver to stop driving the servomotor when the converted load value exceeds the upper load limit.

Preferably, step e) further includes generating an alarm when the converted load value exceeds the upper load limit.

By virtue of storing the at least one relation between the angle value and each of the upper torsion limit and the upper load limit corresponding thereto, the crank press with a dual protection mechanism and the control method thereof according to the present invention may have a torque feedback control function so as to implement a first overload protection mechanism. Moreover, by means of the strain detector module detecting the deformation of the machine body during movement of the slider within a pressing operation, the crank press and the control method thereof may implement a second overload protection mechanism.

BRIEF DESCRIPTION OF THE DRAWINGS

Other features and advantages of the present invention will become apparent in the following detailed description of a preferred embodiment with reference to the accompanying drawings, of which.

DETAILED DESCRIPTION OF THE PREFERRED EMBODIMENT

Figure 1:
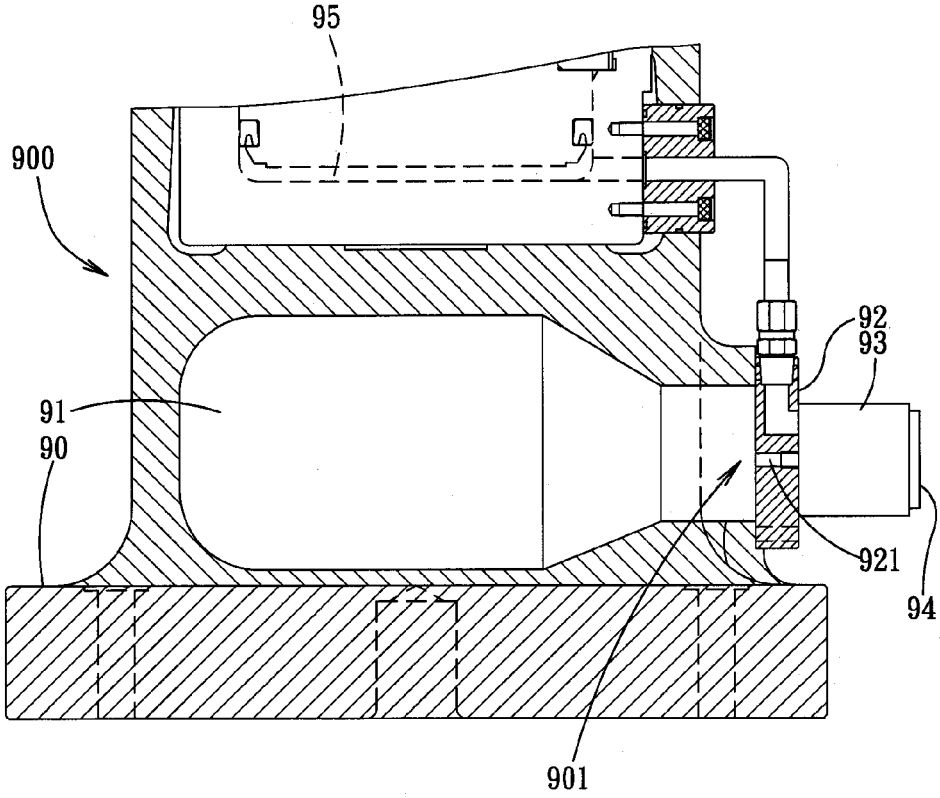
F I G. 1 PRIOR ART
FIG. 1 illustrates a conventional punch device provided with a hydraulic overload protector.
Figure 2:
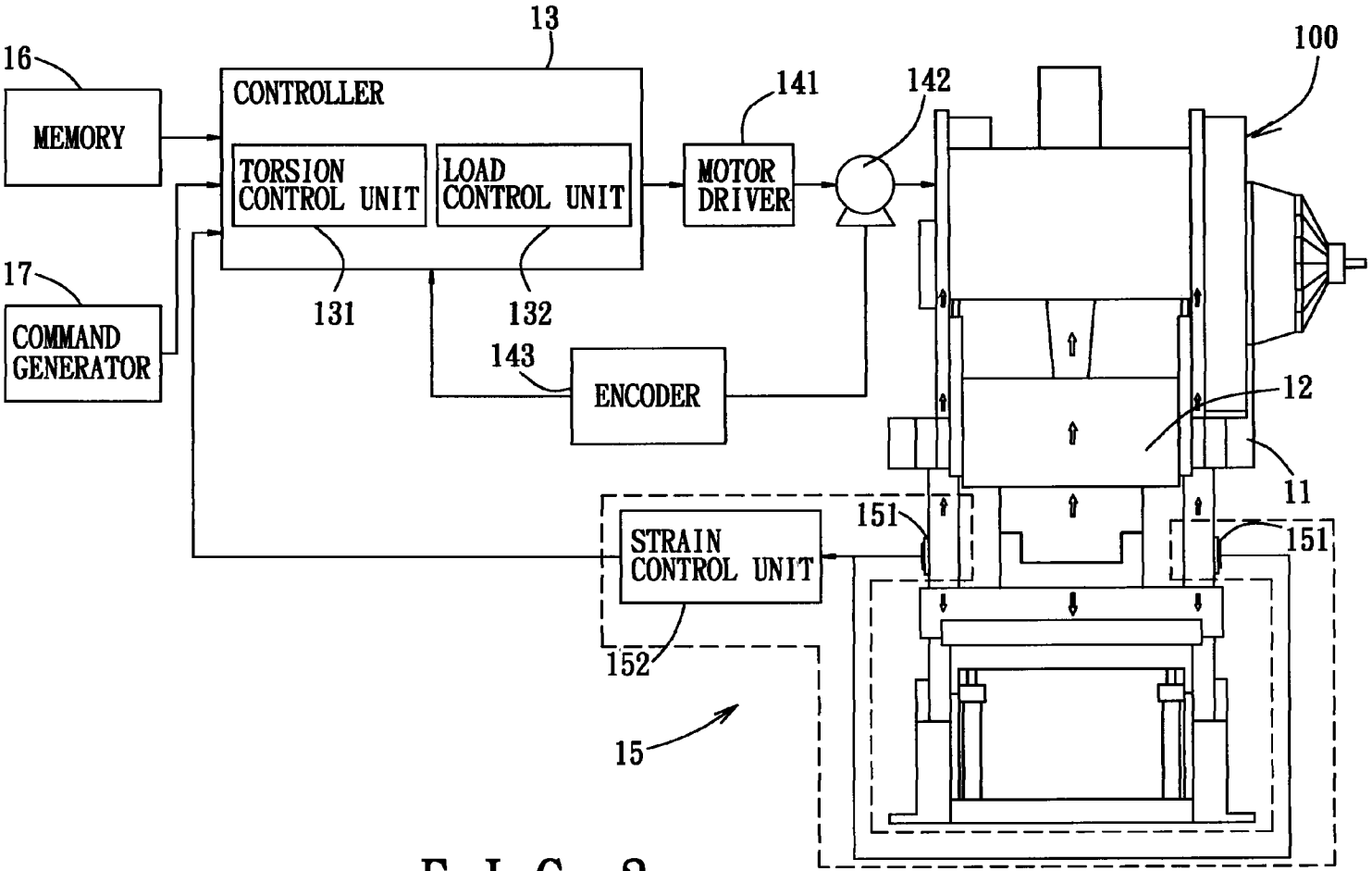
FIG. 2 illustrates a preferred embodiment of a crank press of the present invention.

Referring to FIG. 2, a preferred embodiment of a crank press 100 with a dual protection mechanism according to the present invention comprises a machine body 11, a slider 12, a controller 13, a motor driver 141, a servo motor 142 which is coupled to the slider 12 and which is coupled to and driven by the motor driver 141, a command generator 17, an encoder 143, a strain detector module 15, and a memory 16. The command generator 17 generates, based on a predetermined program or a user operation, a position command which is associated with control of the motor driver 141, and transmits the position command to the controller 13. The controller 13 controls, based on the position command, the motor driver 141 to drive the servo motor 142 to bring about movement of the slider 12 with respect to the machine body 11 via a crankshaft and a connecting rod (not shown).

The controller 13 includes a torsion control unit 131 and a load control unit 132. Detailed operations thereof will be described in the following paragraphs. The memory 16 stores at least one relation between an angle value and each of an upper torsion limit and an upper load limit corresponding thereto. In this embodiment, the relation is stored in a form of a table such as a lookup table 161 shown in FIG. 3. The lookup table 161 stores predetermined angle values, upper torsion limits, and upper load limits.

The encoder 143 detects a rotational position of the servomotor 142, i.e., measures an angle value associated with operation of the servo motor 142, and provides the angle value measured thereby to the controller 13. The strain detector module 15 obtains a converted load value associated with a pressing operation of the slider 12. The pressing operation is implemented by means of the movement of the slider 12 with respect to the machine body 11. Specifically, the strain detector module 15 includes a strain detector unit 151 and a strain control unit 152. The strain detector unit 151 detects deformation of the machine body 11 during movement of the slider 12 within the pressing operation and generates a strain value corresponding to the deformation detected thereby. Specifically, the slider 12 is provided with a mold, and a workpiece is disposed on the machine body 11 corresponding to the mold. When the mold is bought by the slider 12 to press the workpiece, the workpiece simultaneously presses the machine body 11 and a reaction force is applied to the machine body 11 via the slider 12 (see the arrows depicted in FIG. 2) so as to result in the elastic deformation of the machine body 11. It is noted that, referring to FIG. 2, the strain detector unit 151 is disposed on lateral walls of the machine body 11 which in general have a substantially higher degree of instantaneous elastic deformation.

The strain control unit 152 receives the strain value from the strain detector unit 151 and converts the strain value into a converted load value. Specifically, the strain value and the converted load value have a substantially linear relationship therebetween, and a linear equation may be derived based on the linear relationship. Therefore, the strain control unit 152 converts the strain value into the converted load value according to the linear equation.

Preferably, the strain detector unit 151 is a strain gauge, and the strain control unit 152 is a tonnage monitor, such as that available from Murata Machinery, LTD, and variations thereof.

Figure 3:
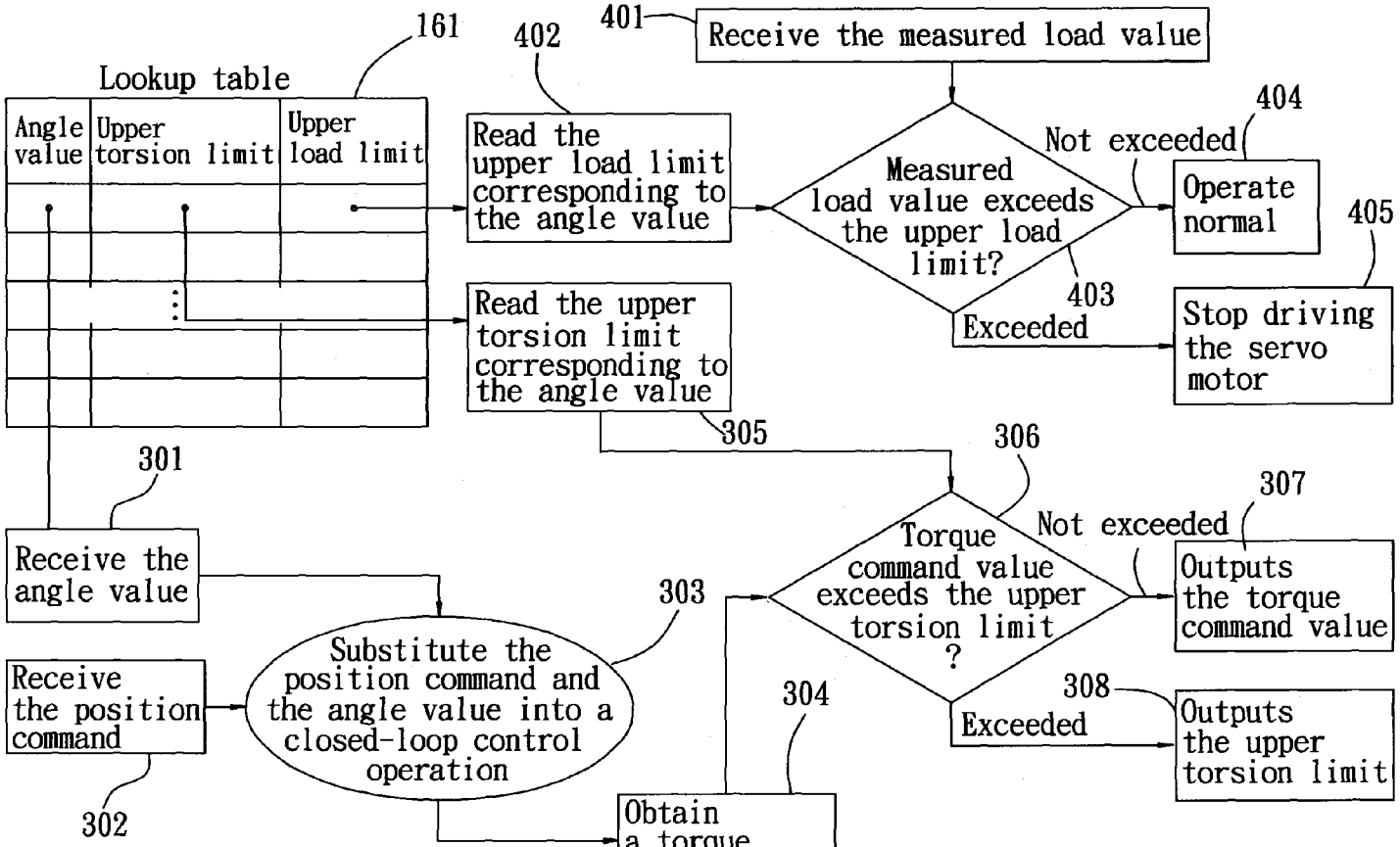
FIG. 3 illustrates a flow chart of a preferred embodiment of a control method of the crank press, and a lookup table of the crank press.

Referring to FIG. 3, in combination with FIG. 2, a preferred embodiment of a control method of the crank press according to the present invention is illustrated. The torsion control unit 131 of the controller 13 performs steps 301-308, i.e., a first overload protection mechanism, and the load control unit 132 of the controller 13 performs steps 401-405, i.e., a second overload protection mechanism.

The first overload protection mechanism is illustrated hereinafter.

In step 301, the torsion control unit 131 receives the angle value measured by the encoder 143. In step 302, the torsion control unit 131 receives the position command from the command generator 17. Insteps 303 and 304, the torsion control unit 131 substitutes the position command and the angle value into a closed-loop logic operation so as to obtain a torque command value. In step 305, the torsion control unit 131 reads from the memory 16 the upper torsion limit corresponding to the angle value received thereby. In step 306, the torsion control unit 131 determines whether the torque command value exceeds the upper torsion limit. In step 307, the torsion control unit 131 outputs the torque command value to the motor driver 141 for driving the servo motor 142 according to the torque command value when the torque command value does not exceed the upper torsion limit. In step 308, the torsion control unit 131 outputs the upper torsion limit to the motor driver 141 for driving the servo motor 142 according to the upper torsion limit when the torque command value exceeds the upper torsion limit.

The second overload protection mechanism is illustrated hereinafter.

In step 401, the load control unit 132 receives the converted load value from the strain control unit 152 and the angle value measured by the encoder 143. In step 402, the load control unit 132 reads from the memory 16 the upper load limit corresponding to the angle value received thereby. In step 403, the load control unit 132 determines whether the converted load value exceeds the upper load limit. In step 404, the load control unit 132 controls the motor driver 141 to drive the servo motor 142 to operate normally when the converted load value does not exceed the upper load limit. In step 405, the load control unit 132 controls the motor driver 141 to stop driving the servo motor 142 when the converted load value exceeds the upper load limit. Preferably, the crank press 100 further generates an alarm when the converted load value exceeds the upper load limit.

The second overload protection mechanism is designed because, during movement of the slider 12 within the pressing operation, an actual pressing force attributed to the pressing operation of the slider 12 is usually greater than a pressing force attributed to a capable output torque of the servo motor 142 for bringing about movement of the slider 12 as a result of an effect of inertia force. Therefore, in the preferred embodiment of the crank press 100, by means of the strain detector module 15, the strain detector unit 151 may detect deformation of the machine body 11 during movement of the slider 12 within the pressing operation, such that the controller 13 may implement an emergency shutdown or alarm generation according to the converted load value and the predetermined upper load limit so as to achieve an effect of active protection.

To sum up, the present invention has a torque feedback control function so as to implement the first overload protection mechanism. Moreover, by means of the strain detector module 15 detecting deformation of the machine body 11 during movement of the slider 12 within the pressing operation, the present invention may implement the second overload protection mechanism. The crank press 100 of the present invention thus has a dual protection mechanism.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A control method for a crank press, the crank press including a machine body, a slider, a motor driver, a servo motor which is coupled to the slider and which is coupled to and driven by the motor driver to bring about movement of the slider with respect to the machine body, and a command generator for generating a position command which is associated with control of the motor driver, the control method comprising the steps of:

a) storing in a memory at least one relation between an angle value and each of an upper torsion limit and an upper load limit corresponding thereto;

b) measuring an angle value associated with operation of the servo motor;

c) generating a strain value corresponding to deformation of the machine body during movement of the slider within a pressing operation, and converting the strain value into a converted load value;

d) calculating a torque command value based on the position command, reading from the memory the upper torsion limit corresponding to the angle value measured in step b), determining whether the torque command value exceeds the upper torsion limit, outputting the torque command value to the motor driver for driving the servo motor according to the torque command value when the torque command value does not exceed the upper torsion limit, and outputting the upper torsion limit to the motor driver for driving the servo motor according to the upper torsion limit when the torque command value exceeds the upper torsion limit; and e) reading from the memory the upper load limit corresponding to the angle value measured in step b), determining whether the converted load value exceeds the upper load limit, and controlling the motor driver to stop driving the servo motor when the converted load value exceeds the upper load limit.

2. The control method as claimed in claim 1, wherein, in step c), the strain value is generated using a strain gauge.

3. The control method as claimed in claim 1, wherein step e) further includes generating an alarm when the converted load value exceeds the upper load limit.

* * * * *